United States Patent [19]

Danner

[11] Patent Number: 4,675,022

[45] Date of Patent: Jun. 23, 1987

[54] AQUEOUS WAX DISPERSIONS USEFUL AS TEXTILE FINISHING AGENTS

[75] Inventor: Bernard Danner, Riedisheim, France

[73] Assignee: Sandoz Ltd., Basel, Switzerland

[21] Appl. No.: 741,605

[22] Filed: Jun. 5, 1985

[30] Foreign Application Priority Data

Jun. 8, 1984 [DE] Fed. Rep. of Germany ..... 3421308

[51] Int. Cl.[4] ..... D06M 13/20; C08L 91/06

[52] U.S. Cl. ..... 8/115.56; 8/115.54; 8/116.1; 8/130; 8/133; 8/648; 8/917; 8/918; 8/922; 8/927; 8/928; 252/8.6; 252/8.8

[58] Field of Search ..... 8/115.54, 115.56, 116.1, 8/133; 252/8.6, 8.8

[56] References Cited

U.S. PATENT DOCUMENTS

| | | | |
|---|---|---|---|
| 3,180,750 | 4/1965 | Shippee et al. | 8/115.56 |
| 3,560,382 | 2/1971 | Finch | 428/369 |
| 4,329,390 | 5/1982 | Danner | 252/8.8 |
| 4,474,668 | 10/1984 | Petzold et al. | 252/8.6 |

FOREIGN PATENT DOCUMENTS

| | | | |
|---|---|---|---|
| 59-130361 | 7/1984 | Japan | 8/115.56 |
| 612440 | 11/1948 | United Kingdom . | |
| 1055344 | 1/1967 | United Kingdom . | |

OTHER PUBLICATIONS

Industrial Waxes, vol. I, pp. 351–357 (1975), H. Bennett.

*Primary Examiner*—A. Lionel Clingman
*Attorney, Agent, or Firm*—Gerald D. Sharkin; Richard E. Vila; Thomas C. Doyle

[57] ABSTRACT

Textile substrates are impregnated with a aqueous disperison of a fine crystalline wax containing carboxy and carboxylic acid ester groups, a paraffin wax and a nonionic emulsifier, optionally together with an optical brightener and/or a resin finish, and then submitted to a heat treatment. The treated textile substrates have improved sewability.

47 Claims, No Drawings

AQUEOUS WAX DISPERSIONS USEFUL AS TEXTILE FINISHING AGENTS

The present invention relates to textile finishing agents for improving the workability of textile substrates in mechanical processes, especially of resin finished or optically brightened textile substrates.

The invention provides a process for finishing a textile substrate comprising applying to the substrate an aqueous dispersion containing essentially (a) a fine-crystalline hydrocarbon wax containing carboxy and carboxylic acid ester groups (b) a paraffin wax, and (c) a non-ionic emulsifier and submitting the treated substrate to a heat treatment.

The aqueous dispersion containing as essential ingredient a fine-crystalline wax component (a), a paraffin wax (b) and a nonionic emulsifier (c) also forms part of the invention.

Fine-crystalline waxes are obtainable by chemical synthesis of from distillation of crude oil. They consist of long-chain aliphatic hydrocarbons which are at least partially branched. They are characterised by having a fine to micro-crystalline structure.

Wax (a) may be obtained by oxidation of fine crystalline hydrocarbon wax according to known methods, for example by ozone or by atmospheric oxygen in the presence of a catalyst, under specific synthesis conditions or/and by partial saponification of oxidised waxes. Examples of suitable waxes (a) are oxidised microcrystalline waxes and preferably oxidised and/or partially saponified Fischer-Tropsch waxes. The waxes (a) may be characterised by the acid number, saponification number and hardness (as measured by the needle penetration value according to known methods such as ASTM-D-1321, DGF M-III-9b or DIN 51 579).

Preferred waxes (a) for use in the present invention are those having, independently, an acid number of 5 to 60, preferably 5 to 35; a saponification number of 10 to 120, preferably 15 to 70; and a needle penetration value according to ASTM-D-1321, DGF M-III 9b or DIN 51 579$\leqq$12, preferably $\leqq$6. Preferably the waxes (a) have a saponification number 1.5 times higher than their acid number.

Particularly preferred waxes (a) are Fischer-Tropsch waxes whose carboxylic acid ester groups have been partially saponified.

The paraffin wax (b) may be a mineral or synthetic wax consisting mainly of saturated hydrocarbons, particularly a paraffin wax obtainable from distillation of crude oil. Such waxes crystallize in the form of large crystals, e.g. plates or needles. They may be characterised by the melting point, the solidification range and the hardness, as measured by the needle penetration value according to known methods. Suitable paraffin waxes (b) are those having, independently, a melting point of at least 30° C., preferably $\geqq$50° C.; a solidification point of at least 30° C., preferably $\geqq$50° C., a needle penetration value according to ASTM-D-1321, DGF M-III-9b or DIN 51579$\leqq$100, preferably $\leqq$85. Particularly preferred waxes (b) are hard paraffin waxes having a penetration value $\leqq$25.

Depending on their production conditions, the paraffin waxes (b) may contain an oil. However, this oil content should be as low as possible; preferably it is $\leqq$5%, particularly $\leqq$1% by weight.

In the aqueous dispersions for use in the present invention, the weight ratio of wax (a) to wax (b) is advantageously 0.05–50:1, preferably 0.1–20:1.

The term "dispersion" herein includes both suspensions of solid particles (i.e. below the melting points of the wax components) and emulsion of liquid droplets in water (i.e. above the melting points of the wax components).

The non-ionic emulsifier (c) used in the aqueous dispersions according to the invention may in principle be any non-ionic surfactant suitable for example for the preparation of oil-in-water emulsions. Such emulsifiers are known; they are disclosed e.g. by N. Schönfeld in "Surface-active Ethylene Oxide Adducts" (Pergamon Press, 1969) or by M. J. Schick in "Non-ionic Surfactants" Vol. 1 of "Surfactant Science Series", Marcel Decker Inc., New York, 1967). The emulsifier (c) may be present in the aqueous dispersion as a single compound or as a mixture of non-ionic emulsifiers.

Suitable non-ionic emulsifiers (c) include oxyalkylation products of higher fatty acids, higher fatty acid amides, higher fatty alcohols, mono- or dialkyl substituted phenols or sorbitan fatty acid mono- or diesters. The higher acids, amides and alcohols preferably contain from 8 to 22, more preferably 12 to 20 carbon atoms per molecule, and the alkyl-substituted phenols are preferably substituted with one or two $C_{4-12}$ alkyl groups. The alkylene oxide chains are preferably composed of the ethylene oxide and optionally propylene oxide units, and more preferably contain at least 50 mole% ethylene oxide units. The most preferred non-ionic emulsifiers of this type are those having 3 to 30 ethylene oxide units and no propylene oxide units, per molecule.

Preferred non-ionic emulsifiers are those of formulae I and II $$R_1\text{-}(O\text{-}CH_2\text{-}CH_2)_m\text{-}OH \qquad \text{(I)}$$

$$R_2\text{-}CO\text{-}N\begin{cases}(CH_2\text{-}CH_2\text{-}O)_n\text{-}H\\(CH_2\text{-}CH_2\text{-}O)_p\text{-}H\end{cases}, \qquad \text{(II)}$$

where $R_1$ is $C_{9-22}$alkyl or $C_{9-22}$alkenyl or a radical of formula (a)

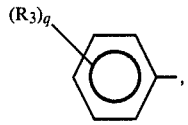

(a)

$R_2$ is $C_{8-21}$ alkyl or $C_{8-21}$ alkenyl each $R_3$, independently, is $C_{4-12}$alkyl m is 3–30 n is at least 1 p is at least 1 and n+p is 3–30 and q is 1 or 2.

In the compounds of formula I or II, respectively, $R_1$ or $R_2$—CO— preferably contains 12 to 20 carbon atoms, particularly 16 to 18.

The total sum of the carbon atoms present in radical (a) is preferably from 14 to 24. Preferred significances for a radical of formula (a) are dibutylphenyl, isooctylphenyl, mono- or dinonylphenyl or monododecyl-phenyl. The values of m, n and p corresponding to the oxyethylation degree of the molecule are selected so that the emulsifier has an average HLB value within the range indicated below.

The non-ionic emulsifier or mixture of non-ionic emulsifiers used as component (c) advantageously has an average HLB value of 6–18, preferably 7–16, particularly 9–15.

The emulsifier (c) is used in sufficient quantity to ensure complete dispersion of the waxes (a)+(b) in the aqueous phase, in order to obtain to stable dispersion at a suitable concentration. Preferably the emulsifier (c) is added in such an amount that the weight ratio (c)/(a)+(b) lies between 0.05:1 and 1:1, preferably between 0.08:1 and 0.75:1, preferably between 0.1:1 and 0.5:1.

In the aqueous dispersions of the invention, when the weight ratio (a)/(b) lies in the upper range, it is preferred to use an emulsifier (c) having an average HLB value of the upper indicated range. On the contrary, when the weight ratio (a)/(b) is low, it is preferred that the emulsifier (c) has a low average HLB value within the above indicated range. The optimum HLB value required for a specific combination of wax (a) and wax (b) may be determined by preliminary testing. Such a testing is well within the skill of the man of the art.

The aqueous dispersions may be prepared in conventional manner, e.g. by melting the wax and emulsifier together and pouring the melt into hot water at the same temperature as the melt or vice versa, i.e. pouring hot water into the melt, with simultaneous or subsequent stirring or shaking, until the desired degree of dispersion is obtained, then cooling the mixture.

The melt of wax plus emulsifier may also contain a non-volatile base, e.g. an alkali metal hydroxide or carbonate such as lithium, sodium or potassium hydroxide, preferably sodium hydroxide, in order to neutralise the free carboxy acid groups of wax (a) into the salt form. The dispersion may optionally contain an antifreeze agent, e.g. mono- or diethyleneglycol or mono- or diethylene glycol—$C_{1-4}$alkyl monoether.

A further non-ionic surfactant having an average HLB value of 15–19 may be added to the aqueous wax dispersion of the invention, as a protective colloid. Such a surfactant may be added in an amount up to 30%, preferably of from 2 to 10%, by weight based on the weight of waxes (a)+(b).

The concentration of waxes (a)+(b) in the aqueous dispersion may vary to the extent that the resulting dispersion is pourable or stirrable. Preferably the aqueous dispersion contains from 5 to 50%, more preferably 8 to 35%, particularly 12 to 26% by weight of waxes (a)+(b). the aqueous dispersion advantageously has a pH from neutral to alkaline, preferably from 7 to 10. The resulting wax dispersion is stable and ready for use.

Suitable substrates for treatment by the process of the invention include those containing natural, synthetic or semisynthetic fibres, or mixtures thereof, particularly those containing natural or regenerated cellulose, natural or synthetic polyamide, polyester, polypropylene or polyacrylonitrile fibres, or mixtures thereof. The material may be in any conventional form, for example as yarn, hanks, cheese, woven or knitted goods, felts, nonwovens, carpets, velvet or tufted goods. Preferably the substrate is in the form of woven or knitted goods, particularly the latter.

The wax dispersion according to the invention is suitable for application by impregnation, e.g. padding, dipping, spray or foam processes or coating. The temperature of application is such as is compatible with the substrate and chemicals used, preferably at room temperature. The pH conditions are not critical for the application.

The treatment according to the invention is preferably carried out as the last finishing step before the mechanical working up of the substrate. It is convenient to carry out the treatment in the same apparatus as that used for an earlier finishing process, e.g. dyeing, optical brightening, resin finishing or another permanent textile finishing. Thus a textile material may for example be finished by a padding operation, in which the last step is padding with the dispersion of the invention.

According to a preferred embodiment of the invention, the process of the invention is carried out simultaneously with another finishing process carried out from an aqueous medium, preferably optical brightening and/or resin finishing treatment.

Any water-soluble or -dispersible optical brightener which can be applied on a textile substrate from an aqueous medium can be used, to the extent that the type of optical brightener employed is matched to the textile to be treated.

Optical brighteners suitable for cellulosic substrates are anionic brighteners, preferably of the 4,4'-bis-(s-triazinylamino)-2,2'-stilbene-disulphonic acid class. Such optical brighteners are known and disclosed e.g. in U.S. Pat. Nos. 3,018,287, 4,252,604, 3,970,647, 4,025,507, in German Pat. No. 1,795,047, in German published patent applications DOS Nos. 1,963,065, 2,056,195, 2,233,429, 2,403,455, 2,430,624, 2,601,749 and 2,715,864 and in Canadian Pat. Nos. 898 248, 680 216 and 921 658.

Particularly preferred optical brighteners for a simultaneous finishing treatment according to the invention are those disclosed in U.S. Pat. Nos. 4,252,604 and 4,025,507, the teaching of which being herein incorporated by reference. These optical brighteners are of formula III

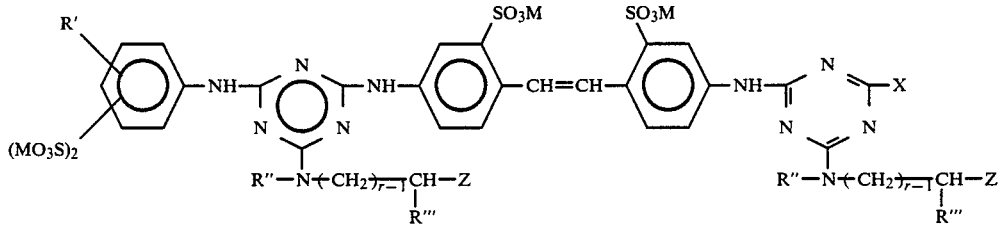

where X is —$NH_2$ or

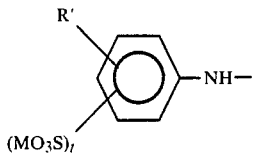

each R', independently, is hydrogen, halogen, $C_{1-5}$alkyl or $C_{1-5}$alkoxy each R'', independently, is hydrogen; $C_{1-5}$alkyl; $C_{1-5}$alkyl substituted by hydroxy, $C_{1-5}$alkoxy, aryl or aryloxy; mono- or di-($C_{1-5}$alkyl)-amino-$C_{1-5}$alkyl; mono- or di-($C_{1-5}$alkyl)-amino-$C_{1-5}$alkyl substituted on the alkyl group(s) by hydroxy or $C_{1-5}$alkoxy groups; cycloalkyl; $C_{1-5}$alkyl-cycloalkyl; phenyl; phenyl substituted by halogen, $C_{1-5}$alkyl or $C_{1-5}$alkoxy groups; or a radical or formula $$\left(CH_2\right)_r-\overset{R'''}{\overset{|}{C}}H-Z$$

each R''', independently, is hydrogen or $C_{1-5}$alkyl each Z, independently, is $-COOR_4$, $-COC_sH_{2s+1}$, cyano or $-CONR_5R_6$ each $R_4$, independently, is $C_{1-5}$alkyl or $C_{1-5}$alkyl substituted by hydroxy, $C_{1-5}$alkoxy, phenyl or phenoxy each $R_5$ or each $R_6$, independently, is hydrogen, $C_{1-5}$-alkyl or hydroxy-$C_{1-5}$-alkyl or $R_5$ and $R_6$ together with the nitrogen atom to which they are bound form a heterocyclic radical each M, independently, is hydrogen, an alkali metal, ammonium or substituted ammonium each r, independently, is 1 or 2 each s, independently, is 1–5 and t 0, 1 or 2.

In the compounds of formula III, R' is preferably hydrogen. Each Z, independently, is preferably cyano or $-CONR_5R_6$.R''' is preferably hydrogen. $R_5$ and $R_6$ are preferably each hydrogen. Each R'', independently, is methyl, ethyl, hydroxy-$C_{2-3}$alkyl, $C_{1-4}$alkoxy-$C_{2-3}$-alkyl, cyclohexyl, benzyl, hydroxyethoxyethyl or optionally hydroxy substituted $C_{1-4}$alkylamino-$C_{2-3}$alkyl such as dimethylaminopropyl or ethanolaminoethyl. Halogen is preferably chlorine. r is preferably 2. t is preferably 1 or 2.

The amount of optical brightener to be used lies within the range usually employed for the optical brightening of a textile substrate.

Resin finishes employing a resin precursor and a catalyst suitable for a simultaneous finishing treatment according to the invention are those giving a finishing having a non-ionic or basic character, particulary those used for the finishing of a cellulosic textile substrate. Such finishes are known and disclosed e.g. by Dr. M. W. Ranney in "Crease-proofing Textiles" (Textile Processing Review, No. 2, NDC, 1970), by Chwala and Anger in "Handbuch der Textilhilfsmittel" (Verlag Chemie, Weinheim, N.Y., 1977, pages 446 to 466), in U.S. Pat. Nos. 4,475,918, 4,439,203, 4,511,707, 4,452,606 and 4,443,223 or in PCT-application No. 81/02423. Preferred resin finishes are those obtained from a resin precursor such as methylol urea, bis-(methoxymethyl)-urea, poly(methylol)-melamine 1,3-bis(hydroxymethyl)-imidazolin-2-one optionally in admixture with poly(methylol)-melamine, 5-substituted-1,3-dimethylol-1,3,5-triaz-2-one, bis(methoxymethyl)-urone, dimethylolpolypropylene urea, a cyclic 1,3-dimethylol-4,5-dihydroxyethylene urea and derivatives, methylolcarbamates and reaction products of a polyalkylene polyamine, especially triethylenetriamine, with dicyanodiamide in the presence of a catalyst such as $MgCl_2$ and with N-methylol-alkylene urea optionally substituted by hydroxy, particularly N,N'-dimethylolethylene urea, N,N'-dimethylolpropylene urea or N,N'-dimethyloldihydroxyethylene urea. The resin precursor and the corresponding catalyst may be used in an amount lying within the usual range.

The total wax (a)+(b) concentration on the substrate can be varied within wide limits according to the nature of the substrate and the desired effect. However, it is mainly independent of the further finishing agent when such is used. Preferably the total wax (a)+(b) concentration lies between 0.05 and 2%, more preferably 0.1 and 1.5%, based on the dry weight of the substrate. In general, it is preferred to apply a slightly higher wax (a)+(b) concentration on a cellulosic substrate than on wool or a synthetic fibre material.

After impregnation with the aqueous dispersion, the substrate is submitted to a heat treatment, e.g. a drying step for example at a temperature of from 80° to 140° C. When the substrate contains synthetic fibres, the heat treatment can be combined with a fixation treatment which may be carried out at a temperature of from 160°–220° C. depending on the nature of the substrate. When the finishing with the aqueous dispersion is performed simultaneously with a resin finishing, the heat treatment may be carried out at a temperature corresponding to the curing temperature of the resin, e.g. at a temperature of from 160° to 190° C. Thus, when a cellulosic substrate is simultaneously treated with the aqueous dispersion and a resin precursor, the impregnated substrate can be first pre-dried for a few seconds, e.g. at a temperature of from 120°–140° C. and then cured at a temperature of from 170°–190° C.

As it will be appreciated, when the process of the invention is carried out simultaneously with an optical brightening or resin finishing treatment, the pH conditions are advantageously selected to be compatible with the brightening agent and/or the resin finish. When the substrate is simultaneously resin finished, the process is preferably carried out at an acidic pH, particularly at pH 3–6.

The process of the invention significantly reduces machine damage, particularly damage by sewing, to the treated textile substrate, so that both fine and thick textile goods, e.g. needle felts or quilts, can be sewn on high-speed industrial machines. The wax finish on the substrate which is produced by the process of the invention has a softening effect and improves the handle of the goods. It may therefore be left on the finished goods, or, if desired, may be removed after the mechanical operations have been completed.

The aqueous dispersions used in the process of the invention, when applied after or simultaneously with an optical brightening and/or resin finishing treatment do not deleteriously affect the brightening and finishing properties. Thus, the invention enables the production of optically brightened textile substrates and resin finished textile substrates having a high whiteness degree, a soft handle and an improved workability. The treatment with an aqueous dispersion according to the invention does not impair the permanence of the resin finishing on the substrate.

The following Exmples, in which all parts are by weight and the temperature in degrees Centigrade, illustrate the invention.

| Examples<br>Starting materials (all commercially available) | |
|---|---|
| (I) Waxes of type a | |
| $W_1$: partially saponified Fischer-Tropsch wax | |
| Solidification range (DGF M-III-4a) | 90–93° |
| Drop range (DGF M-III-3) | 105–115° |
| Hardness (DGF M-III-9b) | 1–2 |
| Viscosity at 120° | 25–50 mPas |
| Acid number | 10–14 |
| Saponification number | 20–30 |
| $W_2$: oxidised microcrystalline wax | |
| Melting point (ASTM-D-127) | |
| Hardness (ASTM-D-1321) | 2 |
| Acid number | 13 |
| Saponification number | 30 |
| $W_3$: oxidised Fischer-Tropsch wax | |
| Solidification range (DGF M-III-4a) | 88–90° |
| Drop range (DGF M-III-3) | 98–102° |
| Hardness (DGF M-III-9b) | 3–6 |
| Viscosity at 120° C. | 10–12 mPas |
| Acid number | 27–32 |
| Saponification number | 48–60 |
| (II) Waxes of type b | |
| $P_1$: refined paraffin wax | |
| Solidification range (ASTM D-87) | 54–56° |
| Drop point (DGF M-III-3) | 56° |
| Hardness (ASTM D-1321) | 20 |
| Oil content (ASTM-D-721) | 0.5% |
| Acid number | 0 |
| Saponification number | 0 |
| $P_2$: refined paraffin wax | |
| Solidification range (ASTM D-87) | 50–52° |
| Drop point (DGF M-III-3) | 53° |
| Hardness (ASTM D-1321) | 80 |
| Oil content | 3–4% |
| Acid number | 0 |
| Saponification number | 0 |
| n-Paraffin content (DGF M-V-8) | 68% |
| $P_3$: refined paraffin wax | |
| Solidification range (DIN 51 556) | 62–64° |
| Hardness (DIN 51579) | ca. 12.0 |
| Oil content (DIN 51 571) | max. 0.5% |
| Acid number | 0 |
| Saponification number | 0 |
| (III) Emulsifier c | |
| $E_1$ $C_{18}H_{37}(OCH_2CH_2)_{10}OH$ | HLB = 12.4 |
| $E_2$ $C_{17}H_{35}-C(=O)(OCH_2CH_2)_{6,4}OH$ | HLB = 10.0 |
| $E_3$ $C_{18}H_{35}(OCH_2CH_2)_{10}OH$ | HLB = 12.4 |
| $E_4$ $C_{17}H_{35}-CON(CH_2CH_2O)_rH(CH_2CH_2O)_sH$<br>r + s = 5 | HLB = 14.0 |
| $E_5$ $C_9H_{19}-C_6H_4-(OCH_2CH_2)_9OH$ | HLB = 12.8 |
| $E_6$ $C_{18}H_{35}(OCH_2CH_2)_{25}OH$ | HLB = 16.1 |

EXAMPLES 1–7 x Parts wax W containing carboxy/carboxylic acid ester groups [of type (a)], y parts paraffin wax P [of type (b)] and 45 parts emulsifier E are melted together with stirring. v Parts of a 30% aqueous sodium hydroxide solution are then added to the mixture and the whole melt is poured into 510 parts boiling water with stirring. The fine emulsion so prepared is allowed to cool and the resulting dispersion is discharged.

| Example | W | P | E | x | y | v |
|---|---|---|---|---|---|---|
| 1 | $W_1$ | $P_3$ | $E_1$ | 152 | 8 | 8 |
| 2 | $W_2$ | $P_3$ | $E_2$ | 152 | 8 | 6 |
| 3 | $W_1$ | $P_1$ | $E_3$ | 60 | 100 | 3 |
| 4 | $W_2$ | $P_2$ | $E_1$ | 80 | 80 | 3 |
| 5 | $W_3$ | $P_3$ | $E_1$ | 152 | 8 | 11 |
| 6 | $W_2$ | $P_2$ | $E_4$ | 80 | 80 | 3 |
| 7 | $W_2$ | $P_3$ | $E_5$ | 152 | 8 | 6 |

EXAMPLE 8

100 Parts paraffin wax $P_3$, 60 parts wax $W_1$ and 20 parts emulsifier $E_1$ are melted together at 120°. After the addition of 3 parts of a 30% aqueous sodium hydroxide solution, the resulting slightly alkaline melt is poured into a solution of 56 parts ethyleneglycol in 478 parts water at 95°. The fine emulsion so prepared is allowed to cool at room temperature. Before discharging, 25 parts of a 30% aqueous solution of emulsifier $E_6$ is added to the resulting dispersion.

EXAMPLE 9

The procedure of Example 8 is repeated but the waxes $P_3$ and $W_1$ are replaced by the same amounts of wax $P_1$ and wax $W_2$, respectively.

EXAMPLES 10–12

152 Parts oxidised microcrystalline or Fischer-Tropsch wax (W), 8 parts paraffin wax $P_3$ and z parts Emulsifier $E_6$ are melted together. After the addition of u parts of a 30% aqueous sodium hydroxide solution, 510 parts water at 95° are added dropwise to the resulting melt. The fine emulsion so prepared is allowed to cool to room temperature.

| Example | W | z | u |
|---|---|---|---|
| 10 | $W_1$ | 30 | 4 |
| 11 | $W_2$ | 30 | 4 |
| 12 | $W_1$ | 40 | 0 |

APPLICATION EXAMPLES A–F

The substrate is padded at room temperature to a pick-up of 80–100% based on its dry weight, with an aqueous bath containing w g/l of a dispersion according to Examples 1, 2, 4, 5 or 6, a resin precursor and/or an optical brightener as indicated in Table 1 below. The impregnated substrate is then submitted to a heat treatment and the sewability of the treated substrate is tested.

TABLE 1

The resin precursor, optical brightener and substrates used are designated as follows:

$S_1$ pre-washed cotton tricot (interlock)*
$S_2$ caustic soda treated, bleached cotton tricot
$S_3$ pre-washed cotton tricot (interlock)*
$S_4$ pre-washed cotton tricot (interlock)*
$O_1$ optical brightener of formula IV TABLE 1-continued The resin precursor, optical brightener and substrates used are designated as follows:

(IV)

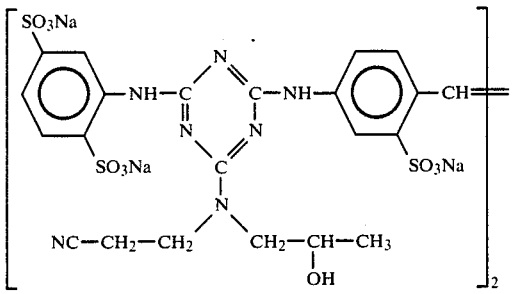

$K_1$ Fixappret COC (BASF) (50% aqueous solution of a dimethylol-4.5-dihydroxyethylene urea derivative)

*Substrates $S_1$, $S_3$ and $S_4$ have each a different strength.

Sewability test method

Two pieces of the same textile substrate are impregnated with the same padding liquor and heat treated separately. After 24 hours equilibration at 65% R.H. and 20°, both treated pieces are sewn together but without sewing thread, with a Pfaff type 483 step stitch sewing machine at a speed of 4800 stitches/min. The penetration force is measured by a strain gauge bridge located under the fabric at the point of sewing, and is registered on a UV chart recorder. The penetration force is read off the recorder when, after an initial period, the sewing speed (4800 stitches/min) becomes approximately constant. The zero value is read off the recorder when the machine is operating at the same speed but without fabric. An average value of the penetration force is taken for 10 seams each of 100 stitches.

The needles used are of the type SES/80 (small ball point) supplied by F. Schmetz GmbH, 5120 Herzogenrath, Germany and are described in their publication Taschenbuch der Nähtechnik, 1975.

TABLE 2

| | | Composition of the treatment liquor | | | | | | | | |
|---|---|---|---|---|---|---|---|---|---|---|
| | | Dispersion | | Optical brightener | | Resin precursor | | Catalyst | | |
| Ex. | Substrate | of Ex. | Amount g/l | Type | Amount g/l | Type | Amount g/l | Type | Amount g/l | Heat treatment |
| A | $S_1$ | 1 | 60 | $O_1$ | 0.8 | — | — | — | — | 140°/90 sec. |
| B | $S_1$ | 1 | 60 | $O_1$ | 0.8 | — | — | — | — | 180°/60 sec. |
| C | $S_2$ | 2 | 60 | — | — | — | — | — | — | 140°/90 sec. |
| D | $S_3$ | 4 | 60 | $O_1$ | 0.8 | $K_1$ | 100 | $MgCl_2$ | 20 | 180°/60 sec. |
| E | $S_4$ | 5 | 60 | $O_1$ | 0.8 | — | — | — | — | 180°/60 sec. |
| F | $S_3$ | 6 | 60 | $O_1$ | 0.8 | $K_1$ | 100 | $MgCl_2$ | 20 | 180°/60 sec. |

By repeating the same procedure but using the dispersions of Examples 3, 7, 8, 9, 10, 11 and 12, similarly good results are obtained: the sewability of the treated goods is improved when compared with non treated goods.

APPLICATION EXAMPLES G–L

The substrate is padded at room temperature to a pick-up of 80–100% bases on its dry weight, with an aqueous bath containing w g/l of the dispersion of Example 8, a resin precursor and/or an optical brightener as indicted below. The impregnated substrate is then submitted to a heat treatment and the sewability of the treated substrate is tested. After 24 hours equilibration at 65% R.H. and 20°, the substrate pieces are sewn together but without sewing thread at a speed of 4800 stitches/min. The average value of the penetration force is taken for 10 seams each of 75 stitches.

EXAMPLE G

| | |
|---|---|
| Substrate: | bleached cotton tricot (interlock) |
| Composition of the finishing liquor: | |
| w: | 15, 30 or 60 g/l of the dispersion of Example 8<br>0.8 g/l optical brightener $O_1$<br>100 g/l 50% dimethylol-dihydroxy-ethylene urea solution<br>20 g/l $Zn(NO_3)_2$<br>acetic acid to pH 3.5 |
| Heat treatment: | drying and curing at 180° for 60 sec. |

EXAMPLE H

Substrate: bleached cotton tricot (interlock).
Composition of the finishing liquor:
w: 15, 30 or 60 g/l of the dispersion of Example 8
0.8 g/l optical brightener $O_1$.
Heat treatment: drying at 140° for 90 sec.

EXAMPLE I

Substrate: polyester tricot (Dacron T 56).
Composition of the finishing liquor:
w: 5, 10 or 20 g/l of the dispersion of Example 8 1 g/l wetting agent N1.
Heat treatment: drying at 140° for 90 sec.

EXAMPLE J

Substrate: polyamide 6 tricot.
Composition of the finishing liquor:
w: 5, 10 or 20 g/l of the dispersion of Example 8 1 g/l wetting agent N1.
Heat treatment: drying at 140° for 90 sec.

EXAMPLE K

Substrate: polyacrylonitrile tricot (Orlon 42).
Composition of the finishing liquor:
w: 5, 10 or 20 g/l of the dispersion of Example 8 1 g/l wetting agent N1.
Heat treatment: drying at 140° for 90 sec.

EXAMPLE L

Substrate: wool gabardine.
Composition of the finishing liquor:
w: 5, 10 or 20 g/l of the dispersion of Example 8 1 g/l wetting agent N1.
Heat treatment: drying at 140° for 90 sec.

The wetting agent N1 is a 30% aqueous solution of di-tert.-butylphenol-decaethyleneglycol ether.

The sewability of the treated goods is significantly improved when compared with non treated goods.

What is claimed is:

1. A process for finishing a textile substrate comprising applying to the substrate an aqueous dispersion containing essentially (a) a fine-crystalline hydrocarbon wax containing carboxy and carboxylic acid ester groups (b) a hard paraffin wax, and (c) non-ionic emulsifier in an amount sufficient to effect complete, stable dispersion of waxes (a) and (b) in the aqueous phase and submitting the treated substrate to a heat treatment.

2. A process according to claim 1, in which the wax (a) is an oxidised microcrystalline wax or an oxidised and/or partially saponified Fischer-Tropsch wax having an acid number of 5 to 60, a sponification number of 10 to 120 and a needle penetration value ≦12.

3. A process according to claim 1, in which the wax (a) is an oxidised microcrystalline wax or an oxidised and/or partially saponified Fischer-Tropsch wax having an acid number of 5 to 35, a saponification number of 15 to 70 and a needle penetration value ≦6.

4. A process according to claim 1, in which the paraffin wax (b) is a hard paraffin wax having needle penetration value ≦25.

5. A process according to claim 1, in which the weight ratio of wax (a) to wax (b) is 0.05–50:1.

6. A process according to claim 1, in which the non-ionic emulsifier (c) is selected from oxyalkylation products of higher fatty acids, higher fatty acid amides, higher fatty alcohols, mono- or dialkyl substituted phenols and sorbitan fatty acid mono- or diesters, the non-ionic emulsifier or mixture of non-ionic emulsifiers (c) having an average HLB value of 6–18.

7. A process according to claim 1, in which the non-ionic emulsifier (c) is a compound of formula I or II $$R_1(O-CH_2-CH_2)_m OH \quad (I)$$

$$R_2-CO-N\begin{matrix}(CH_2-CH_2-O)_n H \\ (CH_2-CH_2-O)_p H\end{matrix}, \quad (II)$$

where $R_1$ is $C_{9-22}$alkyl or $C_{9-22}$alkenyl or a radical of formula (a)

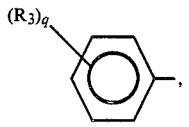

(a)

$R_2$ is $C_{8-21}$ alkyl or $C_{8-21}$ alkenyl each $R_3$, independently, is $C_{4-12}$alkyl m is 3–30 n is at least 1 p is at least 1 and n+p is 3–30 and q is 1 or 2.

8. A process according to claim 1, in which the weight ratio (c) to (a)+(b) is from 0.05:1 to 1:1.

9. A process according to claim 1, in which the aqueous dispersion is applied simultaneously with an optical brightener and/or a resin precursor applicable from an aqueous medium.

10. A process according to claim 9, in which the optical brightener is of formula III

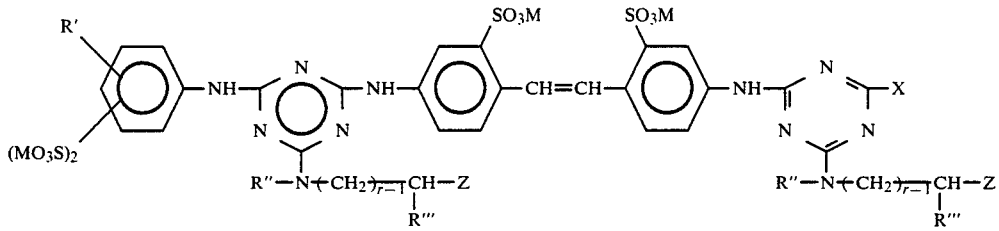

(III)

where X is $-NH_2$ or

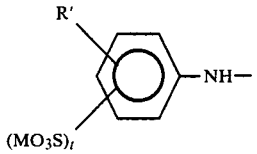

each R′, independently, is hydrogen, halogen, $C_{1-5}$alkyl or $C_{1-5}$alkoxy each R″, independently, is hydrogen; $C_{1-5}$alkyl; $C_{1-5}$alkyl substituted by hydroxy, $C_{1-5}$alkoxy, aryl or aryloxy; mono- or di-($C_{1-5}$alkyl)-amino-$C_{1-5}$alkyl; mono- or di-($C_{1-5}$alkyl)-amino-$C_{1-5}$alkyl substituted on the alkyl group(s) by hydroxy or $C_{1-5}$alkoxy groups; cycloalkyl; $C_{1-5}$alkyl-cycloalkyl; phenyl; phenyl substituted by halogen, $C_{1-5}$alkyl or $C_{1-5}$alkoxy groups; or a radical or formula $$(CH_2)_r-CH(R''')-Z$$

each R‴, independently, is hydrogen or $C_{1-5}$alkyl each Z, independently, is $-COOR_4$, $-COC_sH_{2s+1}$, cyano or $-CONR_5R_6$ each $R_4$, independently, is $C_{1-5}$alkyl or $C_{1-5}$alkyl substituted by hydroxy, $C_{1-5}$alkoxy, phenyl or phenoxy each $R_5$ or each $R_6$, independently, is hydrogen, $C_{1-5}$-alkyl or hydroxy-$C_{1-5}$-alkyl or $R_5$ and $R_6$ together with the nitrogen atom to which they are bound form a heterocyclic radical each M, independently, is hydrogen, an alkali metal, ammonium or substituted ammonium each r, independently, is 1 or 2 each s, independently, is 1–5 and t is 0, 1 or 2.

11. A process according to claim 9, in which the resin precursor is selected from methylol urea, bis-(methoxymethyl)-urea, poly(methylol)-melamine, 1,3-bis(hydroxymethyl)-imidazolin-2-one optionally in admixture with poly(methylol)-melamine, 5-substituted-1,3-dimethylol-1,3,5-triaz-2-one, bis(methoxymethyl)-urone, dimethylolpolypropylene urea, a cyclic 1,3-dimethylol-4,5-dihydroxyethylene urea and derivatives, methylolcarbamates and reaction products of a poly-alkylene polyamine, with dicyanodiamide in the presence of a catalyst and with N-methylol-alkylene urea optionally substituted by hydroxy.

12. A process according to claim 1, in which the total wax (a)+(b) concentration on the substrate is from 0.05 to 2% based on the dry weight of the substrate.

13. A process according to claim 1, in which the substrate contains natural or regenerated cellulose, natural or synthetic polyamide, polyester, polypropylene or polyacrylonitrile or mixtures thereof.

14. A process according to claim 2 wherein wax (b) has a melting point of at least 30° C., a solidification point of at least 30° C. and a needle penetration value no higher than 25.

15. A process according to claim 3 wherein wax (b) has a melting point of at least 50° C., a solidification point of at least 50° C. and a needle penetration value no higher than 25.

16. A process according to claim 14 wherein the weight ratio of wax (a) to wax (b) is 0.05–50:1.

17. A process according to claim 15 wherein the weight ratio of wax (a) to wax (b) is 0.1–20:1.

18. A process according to claim 14 wherein non-ionic emulsifier (c) is an oxyalkylation product of a fatty acid, fatty acid amide or fatty alcohol of 8 to 21 carbon atoms or of a mono- or di-$C_{4-12}$alkyl phenol, which product contains an alkylene oxide chain consisting of ethylene oxide units or ethylene oxide and propylene oxide units and has an HLB value in the range 6–18.

19. A process according to claim 16 wherein non-ionic emulsifier (c) is an oxyethylation product of a fatty acid, fatty acid amide or fatty alcohol of 8 to 22 carbon atoms or of a mono- or di-$C_{4-12}$alkyl phenol, which product contains a chain consisting of 3 to 30 ethylene oxide units and has an HLB value of 7–16.

20. A process according to claim 17 wherein non-ionic emulsifier (c) is an oxyethylation product of a fatty acid, fatty acid amide or fatty alcohol of 12 to 20 carbon atoms or of a mono- or di-$C_{4-12}$alkyl phenol, which product contains a chain consisting of 3 to 30 ethylene oxide units and has an HLB value of 9–15.

21. A process according to claim 1 wherein component (c) comprises a non-ionic emulsifier or mixture thereof constituting the only emulsifier present in the dispersion.

22. A process according to claim 17 wherein component (c) comprises a non-ionic emulsifier or mixture thereof which constitute the only emulsifier present in the dispersion.

23. A process according to claim 18 wherein the weight ratio (c):(a)+(b) is from 0.05:1 to 1:1.

24. A process according to claim 20 wherein the weight ratio (c):(a)+(b) is from 0.1:1 to 0.5:1.

25. A process according to claim 16 wherein the textile substrate comprises fibers of natural or regenerated cellulose, natural or synthetic polyamide, polyester, polypropylene or polyacrylonitrile or mixtures thereof.

26. A process according to claim 16 wherein the total of waxes (a)+(b) applied to the substrate is 0.05 to 2%, based on the dry weight of the substrate.

27. A process according to claim 23 wherein the total of waxes (a)+(b) applied to the substrate is 0.05 to 2%, based on the dry weight of the substrate.

28. A process according to claim 19 wherein the heat treatment is effected at a temperature of 80° to 220° C.

29. A process according to claim 24 wherein the heat treatment is effected at a temperature of 80° to 220° C.

30. A process according to claim 16 wherein the aqueous dispersion is applied simultaneously with an optical brightener and/or a resin precursor applicable from an aqueous medium.

31. A process according to claim 23 wherein the aqueous dispersion is applied simultaneously with an optical brightener and/or a resin precursor applicable from an aqueous medium.

32. A process according to claim 1 wherein component (a) is partially saponified Fischer-Tropsch wax having a solidification range of 90°–93° C., a drop range of 105°–115° C., a hardness of 1–2, a viscosity of 25–50 mPas at 120° C., an acid number 10–14 and a saponification number 20–30; component (b) is refined paraffin wax having a solidification range of 62°–64° C., a hardness of about 12.0, a maximum oil content of 0.5% an acid number 0 and a saponification number 0; and component (c) is a compound of the formula $$C_{18}H_{37}(OCH_2CH_2)_{10}OH$$

having an HLB 12.4.

33. An aqueous dispersion containing as essential ingredients (a) a fine-crystalline hydrocarbon wax containing carboxy and carboxylic acid ester groups (b) a hard paraffin wax, and (c) a non-ionic emulsifier in an amount sufficient to effect complete, stable dispersion of waxes (a) and (b) in the aqueous phase.

34. An aqueous dispersion according to claim 33 wherein (a) is an oxidized microcrystalline wax or an oxidized and/or partially saponified Fischer-Tropsch wax having an acid number of 5 to 60, a saponification number of 10 to 120 and a needle penetration value no higher than 12, (b) is a paraffin wax having a needle penetration value no higher than 25, and (c) is selected from oxyalkylation products of higher fatty acids, higher fatty acid amides, higher fatty alcohols, mono- or dialkyl phenols and sorbitan fatty acid mono- or diesters and mixtures thereof and has an average HLB value of 6–18.

35. An aqueous dispersion according to claim 33 having a pH from neutral to alkaline.

36. An aqueous dispersion according to claim 34 having a pH from neutral to alkaline.

37. An aqueous dispersion according to claim 36 wherein wax (a) has an acid number of 5 to 35, a saponification number of 15 to 70 and a needle penetration value no higher than 6 and non-ionic emulsifier (c) is an oxyethylation product of a fatty acid, fatty acid amine or fatty alcohol of 12 to 20 carbon atoms or of a mono- or di-$C_{4-12}$alkyl phenol, which product contains a chain consisting of 3 to 30 ethylene oxide units and has an HLB value of 9–15.

38. An aqueous dispersion according to claim 37 wherein the weight ratio of wax (a) to wax (b) is 0.05–50:1 and the weight ratio (c) to (a)+(b) is 0.05:1 to 1:1.

39. An aqueous dispersion according to claim 38 wherein component (a) is partially saponified Fischer-Tropsch wax having a solidification range of 90°–93° C., a drop range of 105°–115° C., a hardness of 1–2 a viscosity of 25–50 mPas at 120° C., an acid number 10–14 and a saponification number 20–30; component (b) is refined paraffin wax having a solidification range of 62°–64° C., a hardness of about 12.0, a maximum oil content of 0.5% an acid number 0 and a saponification number 0; and a component (c) is a compound of the formula $$C_{18}H_{37}(OCH_2CH_2)_{10}OH$$

having an HLB of 12.4.

40. An aqueous dispersion according to claim 33 wherein paraffin wax (b) has a needle penetration value no higher than 25.

41. An aqueous dispersion according to claim 40 wherein component (c) has an HLB-value of 6–18.

42. An aqueous dispersion according to claim 40 wherein component (c) has an HLB-value of 9–15.

43. An aqueous dispersion according to claim 41 wherein the weight ratio of wax (a) to wax (b) is 0.1–20:1.

44. An aqueous dispersion according to claim 43 wherein the weight ratio (c):(a)+(b) is in the range 0.05:1 to 1:1.

45. An aqueous dispersion according to claim 44 having a pH in the range 7 to 10.

46. A process according to claim 2 wherein the paraffin wax (b) has a needle penetration value no higher than 25, component (c) has an HLB-value of 7–16 and the weight ratio of wax (a) to wax (b) is 0.1–20:1.

47. A process according to claim 4 wherein component (c) has an HLB-value of 6–18 and the weight ratio of wax (a) to wax (b) is 0.1–20:1.

* * * * *